United States Patent [19]

Thomas

[11] 4,194,078

[45] * Mar. 18, 1980

[54] APPARATUS FOR REGULATING THE DEPTH OF IMMERSION OF CONSUMABLE ELECTRODES IN ELECTROSLAG REMELTING FURNACES

[75] Inventor: Friedrich W. Thomas, Hasselroth, Fed. Rep. of Germany

[73] Assignee: Leybold-Heraeus GmbH & Co. KG, Cologne, Fed. Rep. of Germany

[ * ] Notice: The portion of the term of this patent subsequent to Feb. 21, 1995, has been disclaimed.

[21] Appl. No.: 924,785

[22] Filed: Jul. 14, 1978

[30] Foreign Application Priority Data

Jul. 21, 1977 [DE] Fed. Rep. of Germany ..... 2732873

[51] Int. Cl.[2] ..... H05B 3/60; F27D 11/10

[52] U.S. Cl. ..... 13/9 ES; 13/13

[58] Field of Search ..... 13/12, 13, 9 ES

[56] References Cited

U.S. PATENT DOCUMENTS 4,075,414 2/1978 Thomas ..... 13/13

*Primary Examiner*—Roy N. Envall, Jr.

*Attorney, Agent, or Firm*—Sprung, Felfe, Horn, Lynch & Kramer

[57] ABSTRACT

The invention relates to a system for regulating the depth of immersion of melting electrodes in electrical slag remelting furnaces, consisting of an apparatus for the detection of the reciprocal resistance correspondence to the conductance and for changing this conductance upon the spatial displacement of the end of the electrode within the slag layer, a signal corresponding to the conductance being relayed to a regulating system for the electrode drive.

2 Claims, 2 Drawing Figures

APPARATUS FOR REGULATING THE DEPTH OF IMMERSION OF CONSUMABLE ELECTRODES IN ELECTROSLAG REMELTING FURNACES

BACKGROUND

The invention relates to an apparatus for the regulation of the depth of the immersion of consumable electrodes into the slag of electroslag remelting furnaces, consisting of a system for detecting the actual resistance and the change of this resistance as the electrode is moved within the slag layer, and of a regulating means for the driving of the electrode, to which there is transmitted a signal corresponding to the actual resistance and, as a correction factor, a signal corresponding to the change of the actual resistance, measurement conductors for the melting current i and the melting voltage U being connected with a divider, in accordance with U.S. Pat. No. 4,075,414.

In the subject matter of the principal patent application, the quotient, $$\text{Resistance } R = U/i = (\text{Melting voltage/Melting current})$$

is formed in the divider and corresponds to the actual resistance in the slag blanket. This resistance, represented in relation to the depth of immersion of the electrode, results in hyperbolic curves which asymptotically approach the abscissas and the ordinates of the coordinate system. On the basis of the various apparatus and melting parameters, sets of curves are plotted which have a substantially similar course. These curves are also referred to as "immersion curves." Immersion curves, such as develop in the subject matter of the principal patent application, are also given for purposes of comparison in FIG. 1 appended hereto. It can be seen that the actual resistance R of the slag bath falls off more or less steeply, depending on the tip length $h_s$ of the electrode, as the depth of immersion s increases, dropping all the more steeply as the length of the electrode tip is reduced. The knowledge of this relationship is important in designing the power supply and of the electrode feed control, and also to the operation of the electroslag remelting furnace. On the basis of the curves, slight changes in the depth of immersion, especially in the case of short electrode tips, produce fluctuations of the resultant bath resistance. When controlled-current power supplies are used in production apparatus, allowance must be made for this fact by providing for appropriate voltage reserves in the power supply to assure the operation of the current regulator at all times. Furthermore, the dynamic performance of this current regulator must be set up in accordance with the variation of the electrical furnace circuit time constant resulting from the variations of the bath resistance.

The above situation can be expressed by saying that, on the basis of the "immersion curves" or resistance curves, there is a considerable variation in the amplification factor of the regulating system. The calibration of the electrode feed control is therefore performed, for reasons of stability, for the steep portion of the curves. In this portion, outstanding regulation properties result, i.e., especially in the case of shallow slight immersion and a short tip length $h_s$ on the electrode. This has the disadvantage that, for the flatter portion of the characteristic curves there will be a lower control circuit amplification, which will result in inaccurate control in this portion of the curve.

THE INVENTION

The object of the invention, therefore, is to linearize the control circuit amplification and thereby to make the control operation more uniform over the entire range of immersion depths and tip lengths than it is in the subject of the principal patent application.

The achievement of the object of the invention is accomplished in the above-described apparatus in accordance with the invention in that the divider is constructed such that a signal proportional to the reciprocal of the measured resistance is delivered to its output. This means that in the divider, the quotient $$1/R = G = i/U = (\text{melting current/melting voltage})$$

is formed, which corresponds to the conductance of the slag blanket. If the conductance is plotted against the immersion depth, a set of straight lines will result, i.e., the conductance at a given tip length is proportional to the immersion depth, so that a uniform regulating circuit amplification results. The linearity of the relationship between the conductance and the immersion depth will also obtain for different tip lengths, a particular linear characteristic corresponding to each tip length, so that here again a set of linear characteristics is obtained.

THE DRAWINGS

An embodiment of the subject matter of the invention and the manner of the operation thereof will now be described with the aid of FIGS. 1 and 2, wherein:

FIG. 1 is a parametric representation of "immersion curves," i.e., the relationship between the bath resistance and the immersion depth at different tip lengths $h_s$, on the one hand, and the relationship between the conductance and the immersion depth at different tip lengths on the other hand, and FIG. 2 is a side elevational view, partially in longitudinal cross section, of an electroslag remelting apparatus of the prior art equipped with a control apparatus of the invention.

DETAILED DESCRIPTION

Figure 1:
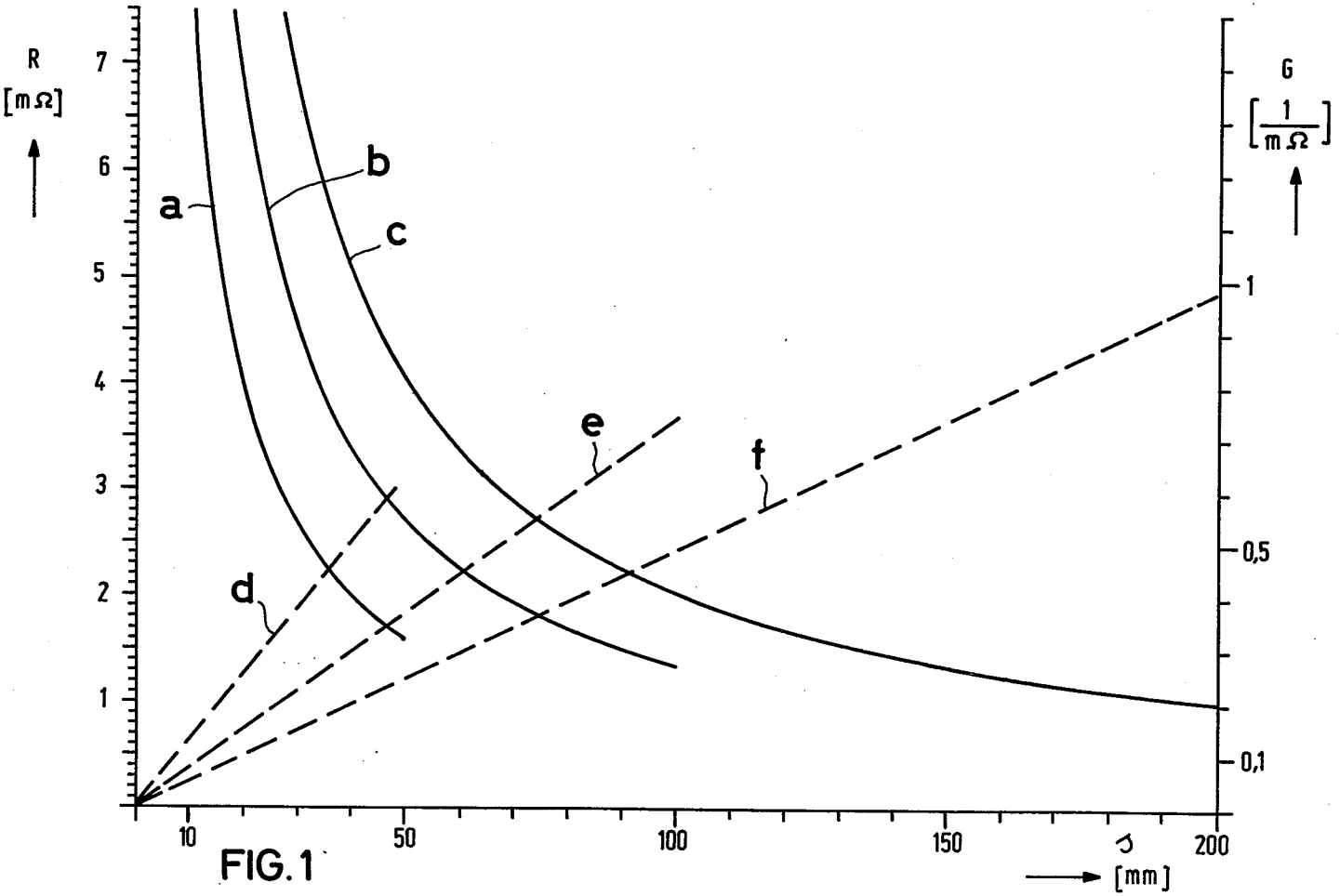

In FIG. 1 there is represented a graph on whose abscissa is plotted the immersion depth s of the electrode end in millimeters, while on the ordinates, on the left is given the ohmic resistance between the electrode clamp and the crucible terminal in milli-ohms, and on the right the reciprocal thereof. These values contain not only the ohmic resistance of the slag blanket, but inevitably also the resistances in the electrical connections and parts of the apparatus. The resistance is therefore called the system resistance. The curves a, b and c represented in solid lines indicate the change of the system resistance as the immersion depth is changed between about 10 mm and 200 mm. The left curve a applies to a consumable electrode tip length $h_s$ of 50 mm, the middle curve b to a tip length of 100 mm, and the right curve c to a tip length of 200 mm. In all cases the depth of the slag blanket was 250 mm and the electrode radius 415 mm.

Basically two different portions can be discerned in the immersion curves a, b and c, namely the portion that becomes flat after the immersion of the entire electrode tip, and the portion that rises steeply after the partial withdrawal of the electrode tip from the slag bath.

If the bath resistance that is to be maintained is specified at the level of the flat portions of the immersion curves, a clear-cut relationship to a particular length $h_s$ of the electrode tip is hardly possible. This is because at this point on the immersion curves, the amplification in the control portions of the curve is very low, i.e., for a slight change in the bath resistance there is a very great change of the immersion depth h and vice versa. As a result, it is scarcely possible to have a definite establishment of the length $h_s$ of the electrode tip when operating within these flat portions of the immersion curves, and this has been confirmed in practice. The broken lines d, e and f represent the relationship of the reciprocal of the resistance, that is, the electrical conductance of the slag. If the reciprocal is used as the control signal, the control portion of the characteristic consequently has a simple proportionality with a control amplification factor that remains constant over the entire range, so that, with a lesser expense in connection with the control system and power supply, a high control accuracy is achievable and with it an extremely uniform melting process. The uniformity of the remelting or crystallization process is an important requirement for the obtaining of a homogeneous ingot.

Figure 2:
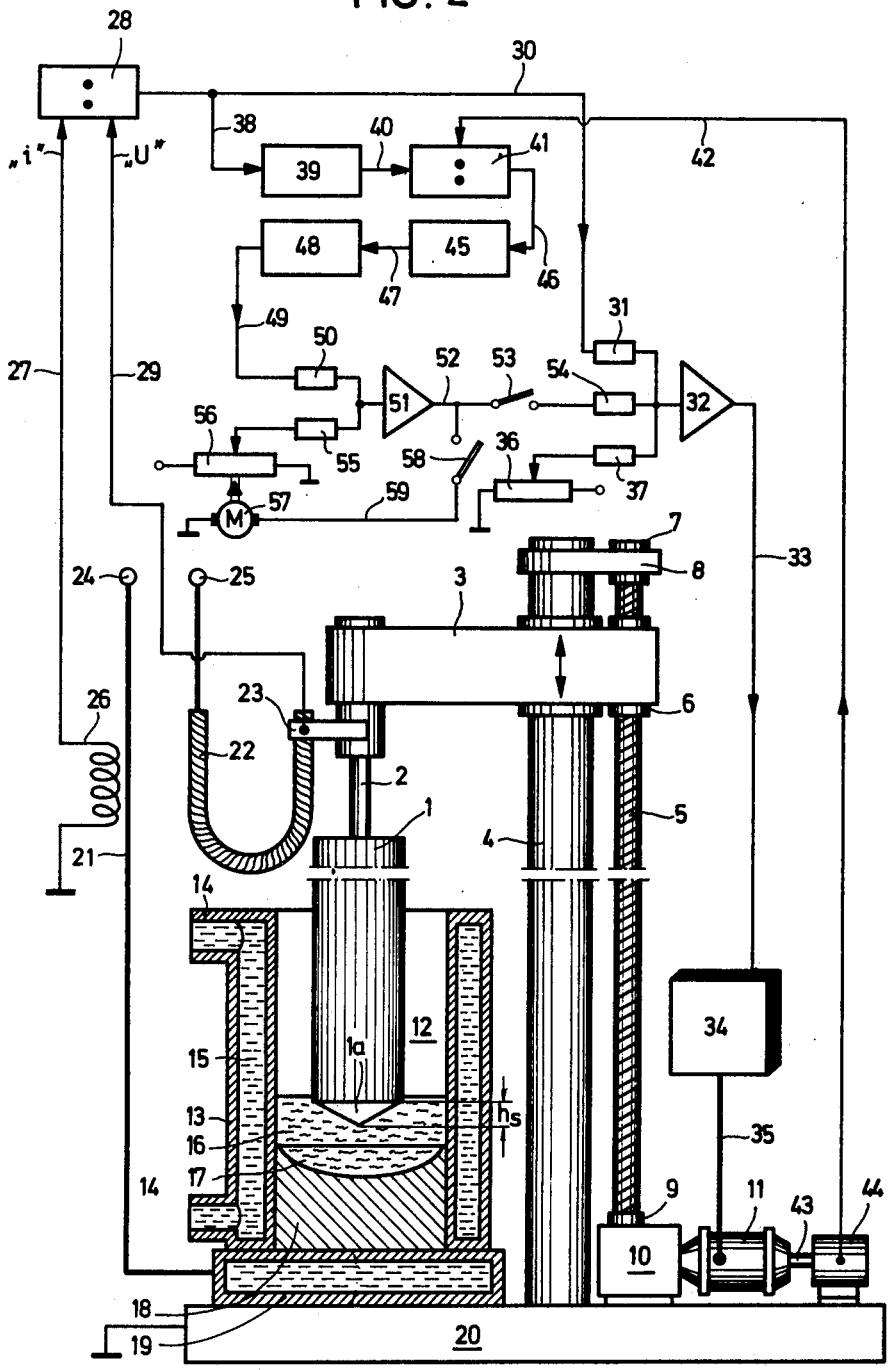

In FIG. 2, 1 designates a consumable electrode of any metal or alloy, which is fastened by means of a shank 2 to a boom 3 of an electrode holding means. The boom 3 can be raised and lowered on a vertical guiding column 4 by means of a screw 5. For this purpose a nut 6 is provided on the boom 3. The screw 5 is held at its upper end in a bearing 7 which is fastened to the guide column by means of a crosspiece 8. The bottom bearing 9 of the screw is contained in a gear box 10 in which the rotatory speed of a drive motor 11 is reduced to an appropriate value. Parts 2 to 11 constitute the electrode feed means.

The consumable electrode 1 is situated with at least a portion of its length within an ingot mold 12 which consists of a wall 13 in the form of a hollow cylindrical jacket having connections 14 for the inlet and outlet of a cooling fluid 15. During the remelting phase, in which the apparatus is represented, the consumable electrode is immersed to a specific, controlled depth in a slag blanket 16, a conical tip 1*a* having the length $h_s$ being formed on the bottom end of the electrode. By the dripping of molten metal from the electrode 1 a pool 17 is formed which solidifies as the remelting proceeds, to form an ingot. The bottom of the ingot mold is a water-cooled floor 19 which rests with the other parts of the installation on a base plate 20.

The electrical power is delivered through a flexible conductor 22 and a terminal clamp 23 to the shank 2 and thence to the electrode 1, on the one hand, and on the other hand it passes through a conductor 21 to the floor 19. Often the floor 19 is electrically insulated from the mold 12 (not shown in the drawing). The conductors 21 and 22 are connected by terminals 24 and 25 to a power supply which is not represented. The melting current i flowing in the system is taken from line 21 by means of a current transformer 26 and delivered through a conductor 27 to a divider 28. Moreover, the melting voltage is taken from line 22 and likewise delivered to the divider 28 in which the quotient of the melting current and the melting voltage i/U is formed, which represents the conductance G. The output of the divider 28 is delivered through a conductor 30 to an input resistance 31 of a regulator 32 for regulating the depth of immersion. By means of a potentiometer 36, a reference voltage corresponding to the preselected conductance is delivered to another input resistance 37 of regulator 32. From the regulator 32, a conductor 33 leads to a control block 34 which is connected by a conductor 35 to the motor 11 operating the electrode feed. In this manner a purely conductance-related regulation of the depth of immersion of the electrode 1 into the slag blanket 16 is achieved.

From the divider 28 another conductor 38 leads to a differentiating circuit 39 for the formation of a derivative dG/dt, whose output is delivered through a conductor 40 to a divider 41. The divider 41 is also to receive from a conductor 42 a voltage corresponding to the rate of movement of the electrode or the differential quotient ds/dt. Since this magnitude in turn depends on the rotatory speed of motor 11, a tachometer generator 44 is coupled to the latter by a shaft 43 and puts out a voltage corresponding to the rotatory speed. The derivative dg/dt and the derivative ds/dt are processed in divider 41 to form the quotient dG/ds, that is, the change in conductance in relation to the displacement of the electrode. In a block 45, which is connected to the divider 41 by a conductor 46, the absolute value of the differential quotient dG/ds is formed. A conductor 47 leads from block 45 to a block 48 in which the differential quotient average is formed. This average is carried by a conductor 49 to an input resistance 50 of a regulator 51 whose output is connected by a conductor 52 and a switch 53 to an input resistance 54 of regulator 32. The switch 53 is closed when the regulator is operated in the fully automatic mode, but it can be opened when the apparatus is started up and when manual control operations are performed. A reference voltage is delivered through an input resistance 55 to the regulator 51, which corresponds to the optimum value of the differential quotient dG/ds. This reference voltage is adjusted at a potentiometer 56 which is a motorized potentiometer driven by a motor 57. This motorized potentiometer permits a smooth input of the correction. This is accomplished by the closing of a switch 58 in a conductor 59 leading to the output of the regulator 51.

The changeover to regulation with correction is performed by then opening the switch 58 and simultaneously closing the switch 53. Thus a smooth changeover takes place, because the reference voltage at the output of the potentiometer 56 is equal to the voltage present in conductor 49 at the moment of the closing of switch 58.

What is claimed is:

1. In an apparatus for the continuous and automatic regulation of the depth of immersion of a driven remelting electrode in the slag layer of an electroslag remelting furnace, comprising regulating means for maintaining the depth of immersion essentially constant at a predetermined value, the improvement comprising: first circuit means for detecting the actual resistance of the current-path through the slag layer and for producing a first signal corresponding to the reciprocal of the actual resistance corresponding to the conductance of the current path, and second circuit means for detecting the changing of the conductance upon the spatial displacement of the electrode within the slag layer and for producing a second signal defining a correction signal corresponding to the changing of the conductance and means receptive of the first signal corresponding to the reciprocal of the actual resistance from the said first circuit means and the second signal from the second circuit means for algebraically summing the two and responsive to the sum for controlling the driving of remelting electrode to effect immersion thereof to a depth, wherein the relationship between said first signal corresponding to the conductance and the immersion depth is essentially linear whereby a uniform regulation amplification results.

2. The apparatus according to claim 1, wherein the first circuit means comprises a first divider receptive of and melting voltage and the melting current, and the second circuit means comprises a differentiating circuit receptive of the first signal and a second divider receptive of a signal proportional to the speed of the electrode drive and the output of the first divider.

* * * * *